US006648238B2

(12) United States Patent
Larke

(10) Patent No.: US 6,648,238 B2
(45) Date of Patent: Nov. 18, 2003

(54) ELECTRICALLY INSULATING RAIL PAD

(75) Inventor: Roger David Larke, Retford (GB)

(73) Assignee: Pandrol Limited, Addlestone (GB)

( * ) Notice: Subject to any disclaimer, the term of this patent is extended or adjusted under 35 U.S.C. 154(b) by 0 days.

(21) Appl. No.: 09/804,203

(22) Filed: Mar. 12, 2001

(65) Prior Publication Data

US 2001/0023898 A1 Sep. 27, 2001

(30) Foreign Application Priority Data

Mar. 24, 2000 (GB) ..... 0007300

(51) Int. Cl.[7] ..... E01B 9/38
(52) U.S. Cl. ..... 238/264
(58) Field of Search ..... 238/264, 272, 238/275

(56) References Cited

U.S. PATENT DOCUMENTS

| | | | | |
|---|---|---|---|---|
| 1,337,621 A | * | 4/1920 | Randall | 238/264 |
| 1,489,238 A | * | 4/1924 | Duffy et al. | 238/264 |
| 4,061,270 A | * | 12/1977 | Wandrisco | 238/107 |
| 4,109,860 A | | 8/1978 | Serafin et al. | 238/349 |
| 4,316,578 A | * | 2/1982 | Reynolds et al. | 238/283 |
| 4,946,099 A | | 8/1990 | Bratchell | 238/264 |
| 4,967,954 A | | 11/1990 | von Lange | 238/310 |
| 5,096,119 A | | 3/1992 | Schultheiss et al. | 238/349 |

FOREIGN PATENT DOCUMENTS

| | | | | |
|---|---|---|---|---|
| AU | 8018675 | | 10/1976 | |
| GB | 69418 | | 4/1951 | |
| GB | 834320 | | 6/1958 | |
| GB | 1029247 | | 9/1962 | |
| GB | 1217331 | | 1/1968 | |
| GB | 2051187 | * | 6/1979 | E01B/9/68 |
| GB | 2051187 | | 1/1981 | |
| GB | 2105389 | | 3/1983 | |
| GB | 2114635 | | 8/1983 | |
| GB | 2146375 | | 4/1985 | |
| GB | 2211229 | | 6/1989 | |
| GB | 2211230 | | 6/1989 | |
| GB | 2211231 | | 6/1989 | |

* cited by examiner

*Primary Examiner*—S. Joseph Morano
*Assistant Examiner*—Robert J. McCarry, Jr.
(74) *Attorney, Agent, or Firm*—Gottlieb, Rackman and Reisman, P.C.

(57) ABSTRACT

A rail pad (1), for electrically isolating a railway rail (2), comprises a rail seat portion (11) for supporting a foot of the rail (2), a pair of upstands (12) joined to opposite edges of the rail seat portion (11) of the pad (1) by respective webs such that respective channels (13) for directing water away from the rail are defined between the rail seat portion (11) of the pad (1) and each adjacent upstand (12). Such a pad provides improved wet electrical resistance.

8 Claims, 2 Drawing Sheets

11
12
12A
13
14
15
16T
16L
16B
16R
17
A
B
C

ELECTRICALLY INSULATING RAIL PAD

BACKGROUND OF THE INVENTION

The present invention relates to a rail pad for electrically isolating a railway rail from an adjacent rail fastening anchoring device (or shoulder) and a rail foundation.

DESCRIPTION OF THE PRIOR ART

In modern railway systems many electrical signals, for communication and rail traffic signalling purposes, are passed along railway rails. In order to prevent the conduction of such signals between the two rails, insulating rail pads are provided beneath the rail foot and insulators are provided between the rail foot and adjacent shoulders.

With the increasing use of steel sleepers such electrical insulation has become even more important. It is of course vital that such insulators function not only in dry conditions but also in wet conditions. A rail fastening assembly incorporating a standard rail pad is typically expected to have a wet electrical resistance of at least 5 k Ohms. However, some track operators require a far higher electrical resistance, for example 20 k Ohms.

BRIEF SUMMARY OF THE INVENTION

According to a first aspect of the present invention there is provided a rail pad for electrically isolating a railway rail, the pad comprising a rail seat portion for supporting a foot of the rail, wherein the pad further comprises a pair of upstands joined to opposite edges of the rail seat portion of the pad by respective webs such that respective channels for directing water away from the rail are defined between the rail seat portion of the pad and each adjacent upstand.

Such a pad, which can be used on either discrete or continuous rail foundation, has an improved wet electrical resistance compared with prior art pads, since moisture falling on a rail fastening assembly in which the pad is used will be directed away from the assembly by the channels, in the manner of gutters. Moreover, electrical path length is increased.

When used on a railway sleeper such that the said channels run normal to the longitudinal axis of the rail foundation, the pad preferably overhangs at least one edge of the said rail foundation, thus directing moisture away from the rail foundation.

Such a pad desirably further comprises a lip provided on the underside of at least one of the edges of the pad which is to overhang the edge of the railway sleeper, allowing the pad to shed drips.

Desirably, the pad further comprises two pairs of spaced-apart tabs extending from opposite edges of the said pad alongside the said channels, each pair of tabs forming a recess therebetween for receiving a railway rail anchoring device, whereby the pad is located on the rail foundation.

Preferably, when used in a rail fastening assembly including electrical insulators, positioned between the rail and respective rail fastening anchoring devices, the height of each of the said upstands is such that the upstand overlaps the lower edge of the adjacent insulator, thereby further improving wet electrical resistance of the pad.

According to a second aspect of the present invention there is provided an assembly for electrically isolating a railway rail, the assembly comprising a rail pad in accordance with the first aspect of the present invention and an insulator for location between the rail and a rail fastening anchoring device, the insulator having a post portion which extends between the rail and the said rail fastening anchoring device, a lower edge of which post portion is formed with a downwardly-extending tab whereby when the insulator is in its operative configuration the tab is located within the channel of the rail pad.

Preferably, the length of the said tab is substantially equal to or greater than the width of the said rail fastening device.

BRIEF DESCRIPTION OF THE DRAWINGS

Reference will now be made, by way of example, to the accompanying drawings, in which.

DETAILED DESCRIPTION OF THE INVENTION

Figures 1A, 1B, 2A, 2B, 2C:
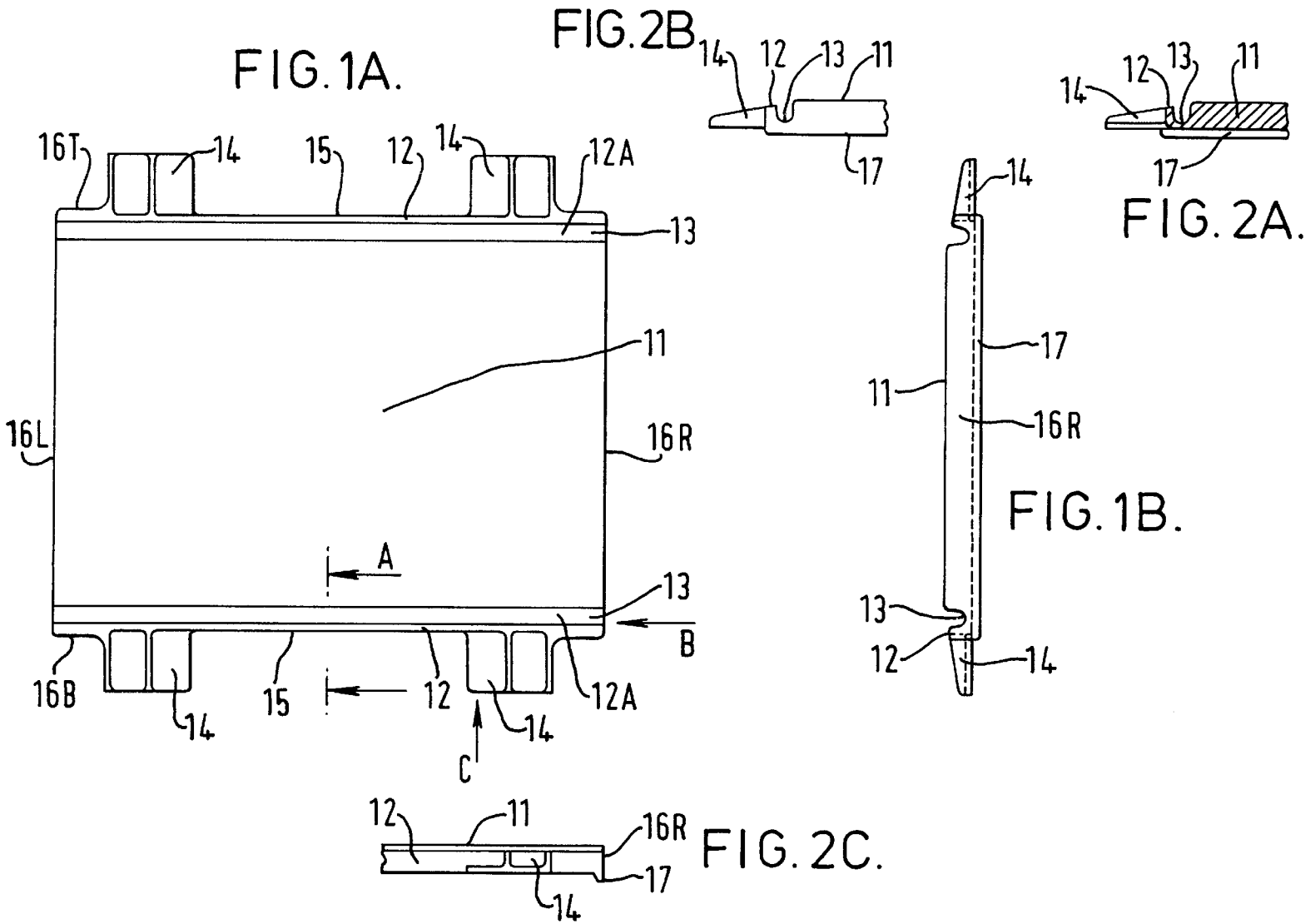
FIGS. 1A and 1B show respective plan and side views of a rail pad embodying the first aspect of the present invention.
FIGS. 2A, 2B and 2C show respective partial views taken on lines A—A, B and C in FIG. 1A.

As shown in FIGS. 1A, 1B, 2A, 2B and 2C, a rail pad 1 embodying the first aspect of the present invention comprises a rail seat portion 11 for supporting a foot of a rail (rail foot not shown in FIGS. 1A to 2C). The rail seat portion 11 is rectangular and along two opposite sides 16T, 16B thereof, defined between the rail seat portion 11 and respective upstands 12 which are connected by respective webs 12A, it has channels 13. These channels 13 are provided so as to allow water coming into contact with the rail fastening assembly in which the pad is used to be directed away from the rail in the manner of a gutter and to increase electrical path length. This embodiment is intended for use on a railway sleeper, rather than on slab track, and accordingly the width of the pad (normal to the axis of the sleeper) is chosen to be such that each of its sides 16L, 16R will overhang the sleeper edge, thereby directing water away from the sleeper. Furthermore, sides 16L and 16R of the rectangular pad 1 are provided along their undersides with respective lips 17 (only one of which is shown) to shed drips.

In order to locate the pad on the sleeper it is provided with tabs 14, there being a pair of tabs 14 along each side 16T, 16B defining between them a recess 15 for receiving a rail fastening shoulder (not shown in FIGS. 1A to 2C) secured to the sleeper.

In one embodiment the pad 1 is 210 mm wide and across each of its ends 16L, 16R is 162 mm. Between the tabs 14 the pad narrows to 158 mm, the rail seat portion 11 being 140 mm by 210 mm. The width of the tabs 14 in the recess 15 is 23 mm. The depth of the pad at the rail seat portion 11 is 10 mm except at each end 16L and 16R where the lip extends this by 3 mm. The channels 13 are 7 mm wide at their tops and 6 mm deep.

Figure 3A:
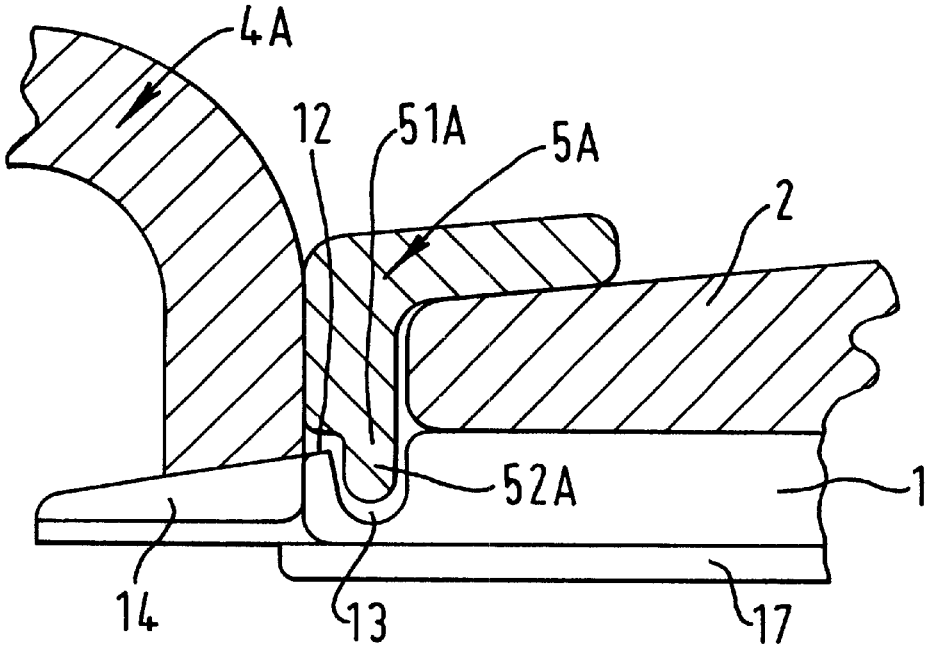
FIGS. 3A and 3B show respective partial cross-sectional views of a rail fastening assembly incorporating a rail pad embodying the first aspect of the present invention and an insulator embodying the second aspect of the present invention.
Figure 3B:
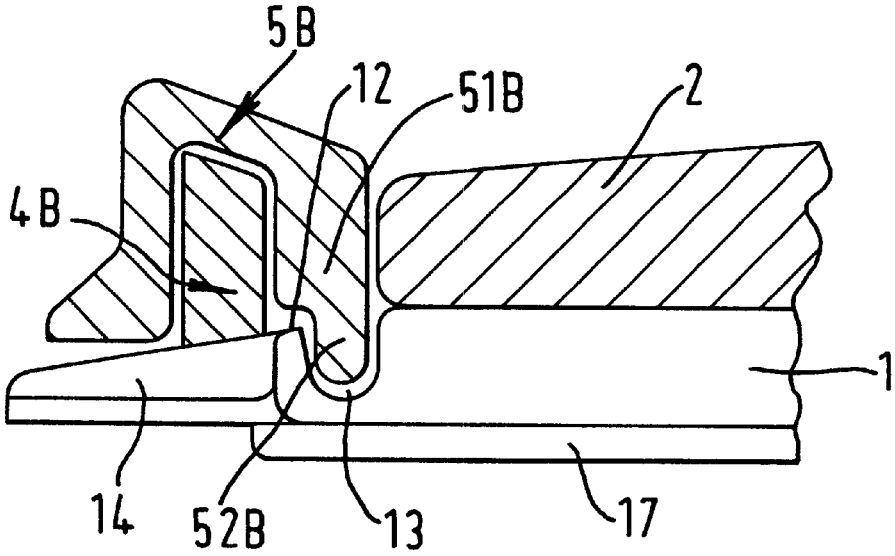

Two examples of the use of the rail pad 1 are shown in FIGS. 3A and 3B respectively. In each case, the rail pad 1 is located beneath the foot of a rail 2 on a railway sleeper (not shown). The foot of the rail 2 sits on the rail seat portion 11 of the rail pad 1. The rail pad 1 is located between a pair of rail fastening shoulders, 4A in FIGS. 3A and 4B in FIG. 3B (only one of each kind is shown in each Figure) such that the shoulders 4A or 4B are located in the recesses 15.

Between the rail seat portion 11 of the rail pad 1 and the adjacent shoulder 4A or 4B are the upstand 12 and channel 13. FIG. 3A illustrates the situation in which an L-shaped insulator 5A is provided, having a portion which rests on the rail 2. FIG. 3B illustrates a situation in which an insulator 5B is located on the shoulder 4B. In each case the insulators 5A, 5B have respective post portions 51A, 51B which extend between the shoulders 4A or 4B and the rail 2. Each post portion 51A, 51B has a tab 52A, 52B which extends into the channel 13 so there is substantial overlap between the tab 52A, 52B and the upstand 12, so as to further improve wet electrical resistance.

Although the pad is shown as having a flat rail seat portion, it may alternatively have a studded or some other surface profile.

It is anticipated that a rail pad embodying the present invention will have a wet electrical resistance of at least 25 k Ohms.

What I claim is:

1. A rail pad, for use on a railway sleeper having a longitudinal axis, for electrically isolating a railway rail from the railway sleeper, the pad comprising a rail seat portion having a top surface for supporting a foot of the rail, wherein the pad further comprises a pair of upstands joined to opposite edges of the rail seat portion of the pad by respective webs each disposed at a level lower than that of the top surface of the rail seat portion, such that respective channels running normal to the longitudinal axis of the railway sleeper are defined between the rail seat portion of the pad and each adjacent upstand so that the channels constitute respective gutters adapted to direct water away from the rail, and wherein the pad overhangs at least one edge of the railway sleeper.

2. A rail pad as claimed in claim 1, further comprising a lip provided on the underside of at least that one of the edges of the pad which is to overhang the at least one edge of the railway sleeper.

3. A rail pad as claimed in claim 1, further comprising two pairs of spaced-apart tabs extending outwardly from opposite edges of the pad alongside the respective channels, each pair of tabs forming therebetween a recess for receiving a rail fastening anchoring device.

4. A rail pad as claimed in claim 1, when used in a rail fastening assembly including respective electrical insulators, positioned between the rail and respective rail fastening anchoring devices, for additionally electrically insulating the rail from the rail fastening anchoring devices, wherein each of the insulators has a respective lower edge, and the height of each of the upstands is such that the upstand overlaps the lower edge of the adjacent insulator.

5. An assembly for electrically isolating a railway rail, the assembly comprising a rail pad as claimed in claim 1 and at least one insulator for location between the rail and a proximate rail fastening anchoring device, the insulator having a post portion which extends between the rail and the proximate rail fastening anchoring device, and the post portion of the insulator having a lower edge which is formed with a downwardly-extending tab, whereby when the insulator is in its operative configuration the downwardly-extending tab of the post portion is located within the associated channel of the rail pad.

6. An assembly as claimed in claim 5, wherein length of the downwardly-extending tab on the insulator is substantially equal to or greater than the width of the proximate rail fastening anchoring device.

7. An insulator for use in an assembly for electrically isolating a railway rail, which assembly includes a rail pad as claimed in claim 1, characterized in that:

the insulator comprises a post portion having a lower edge at which the post portion is formed with a downwardly-extending tab, and the arrangement of the post portion and the downwardly-extending tab is such that, for the purpose of an operative configuration of the insulator relative to a rail and a proximate rail fastening anchoring device, the post portion of the insulator is adapted to be interposed between the rail and the proximate rail fastening anchoring device, and the downwardly-extending tab on the lower edge of the post portion of the insulator is adapted to be located within a proximate channel of the rail pad.

8. An insulator as claimed in claim 7, characterized in that the downwardly-extending tab of the post portion of the insulator is shaped so as to have a length which is substantially equal to or greater than the width of the proximate rail fastening anchoring device.

* * * * *